US012753518B2

(12) United States Patent
Helman

(10) Patent No.: US 12,753,518 B2
(45) Date of Patent: Oct. 6, 2026

(54) HYDROGEN PRODUCTION CATHODE AND ANODE

(71) Applicant: Civilized Power, LLC, Dallas, TX (US)

(72) Inventor: Herby Helman, Potomac, MD (US)

(73) Assignee: Civilized Power, LLC, Dallas, TX (US)

( * ) Notice: Subject to any disclaimer, the term of this patent is extended or adjusted under 35 U.S.C. 154(b) by 927 days.

(21) Appl. No.: 17/852,092

(22) Filed: Jun. 28, 2022

(65) Prior Publication Data

US 2022/0411939 A1 Dec. 29, 2022

Related U.S. Application Data

(60) Provisional application No. 63/202,877, filed on Jun. 28, 2021.

(51) Int. Cl.

| | |
|---|---|
| ***C25B 1/04*** | (2021.01) |
| ***C25B 9/015*** | (2021.01) |
| ***C25B 9/13*** | (2021.01) |
| ***C25B 9/17*** | (2021.01) |
| ***C25B 9/19*** | (2021.01) |
| ***C25B 9/63*** | (2021.01) |
| ***C25B 11/031*** | (2021.01) |

(52) U.S. Cl.

CPC ..... *C25B 1/04* (2013.01); *C25B 9/015* (2021.01); *C25B 9/13* (2021.01); *C25B 9/17* (2021.01); *C25B 9/19* (2021.01); *C25B 9/63* (2021.01); *C25B 11/031* (2021.01)

(58) Field of Classification Search

CPC .... C25B 1/04; C25B 9/17; C25B 9/19; C25B 9/70; C25B 11/02

See application file for complete search history.

(56) References Cited

U.S. PATENT DOCUMENTS

| | | | | |
|---|---|---|---|---|
| 4,078,985 | A * | 3/1978 | Takeuchi | C25B 9/17 205/639 |
| 4,124,463 | A * | 11/1978 | Blue | C25B 1/04 205/630 |
| 4,265,719 | A * | 5/1981 | Ezzell | C25B 1/46 205/531 |
| 2008/0257751 | A1* | 10/2008 | Smola | F02B 43/10 205/628 |
| 2016/0049677 | A1* | 2/2016 | Müller | B32B 15/043 429/480 |
| 2022/0064807 | A1* | 3/2022 | Lewis | C25B 9/15 |

FOREIGN PATENT DOCUMENTS

| | | | | |
|---|---|---|---|---|
| EP | 1041175 | A1 * | 10/2000 | C25B 1/044 |
| KR | 20090097309 | A * | 9/2009 | C25B 1/044 |

OTHER PUBLICATIONS

Machine translation of KR20090097309 of Lee (Year: 2009).*

* cited by examiner

*Primary Examiner* — Brian W Cohen

(57) ABSTRACT

An apparatus and a hydrogen car including the apparatus to generate hydrogen. The apparatus includes a housing, an anode plate, a cathode plate, and a power source. The housing is configured to contain a fluid. The anode plate is installed in the housing and configured to extend into the fluid. The cathode plate is installed in the housing and configured to extend into the fluid, the cathode plate including a plurality of holes. The power source is mounted on the housing and electrically coupled to the anode plate and the cathode plate.

20 Claims, 6 Drawing Sheets

HYDROGEN PRODUCTION CATHODE AND ANODE

CROSS-REFERENCE TO RELATED APPLICATION AND PRIORITY CLAIM

This application claims priority under 35 U.S.C. § 119(e) to U.S. Provisional Patent Application No. 63/202,877 filed on Jun. 28, 2021, which is hereby incorporated by reference in its entirety.

TECHNICAL FIELD

This disclosure relates generally to hydrogen production devices and processes. More specifically, this disclosure relates to a cathode and anode arrangement for hydrogen production.

BACKGROUND

Existing designs for anodes and cathodes include solid plates stacked vertically close together to produce hydrogen. This method produces a small amount of hydrogen for the surface area used and requires a significant number of plates to produce larger quantities of hydrogen resulting in higher cost and larger footprints.

SUMMARY

This disclosure provides a hydrogen production cathode and anode.

In a first embodiment, an apparatus includes apparatus includes a housing, an anode plate, a cathode plate, and a power source. The housing is configured to contain a fluid. The anode plate is installed in the housing and configured to extend into the fluid, the anode plate including a plurality of holes. The cathode plate is installed in the housing and configured to extend into the fluid, the cathode plate including a plurality of holes. The power source is mounted on the housing and electrically coupled to the anode plate and the cathode plate.

In a second embodiment, a hydrogen vehicle includes an electrolysis apparatus and a hydrogen engine. The electrolysis apparatus includes apparatus includes a housing, an anode plate, a cathode plate, and a power source. The housing is configured to contain a fluid. The anode plate is installed in the housing and configured to extend into the fluid, the anode plate including a plurality of holes. The cathode plate is installed in the housing and configured to extend into the fluid, the cathode plate including a plurality of holes. The power source is mounted on the housing and electrically coupled to the anode plate and the cathode plate. The hydrogen engine is fluidly connected to the electrolysis apparatus to receive the generated hydrogen and configured to operate on the generated hydrogen Other technical features may be readily apparent to one skilled in the art from the following figures, descriptions, and claims.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 5, described below, and the various embodiments used to describe the principles of the present disclosure are by way of illustration only and should not be construed in any way to limit the scope of the disclosure. Those skilled in the art will understand that the principles of the present disclosure may be implemented in any type of suitably arranged device or system.

Figure 1:
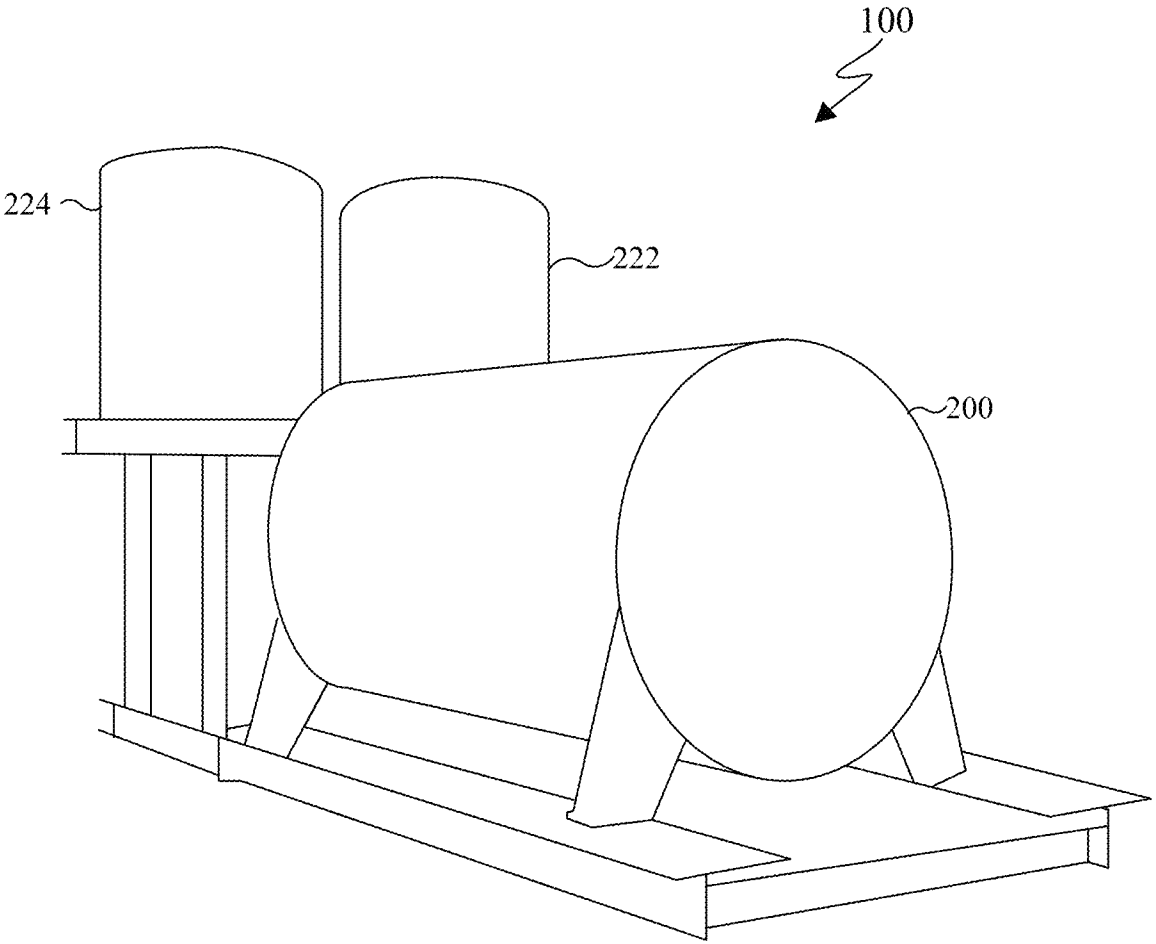
FIG. 1 illustrates an example electrolysis system in accordance with this disclosure.

FIG. 1 illustrates an example electrolysis system 100 in accordance with this disclosure. The embodiment of the electrolysis system 100 illustrated in FIG. 1 is for illustration only. FIG. 1 does not limit the scope of this disclosure to any particular implementation of an electrolysis system.

The electrolysis system 100 can perform electrolysis to separate an electrolyte (e.g., water) to produce an anode gas (e.g., oxygen gas) and a cathode gas (e.g., hydrogen gas). The electrolysis system 100 can include an electrolysis apparatus 200, an anode gas storage 222, and a cathode gas storage 224. The electrolysis system 100 can produce an amount of anode gas and cathode gas for industrial uses. The anode gas produced by the electrolysis system 100 can be captured or stored in the anode gas storage 222 and the cathode gas produced by the electrolysis system 100 can be captured or stored in the cathode gas storage 224. The specific details of the electrolysis apparatus 200, the anode gas storage 222, and the cathode gas storage 224 are described below in greater detail.

Although FIG. 1 illustrate an example electrolysis system 100, various changes may be made to FIG. 1. For example, the sizes, shapes, and dimensions of the electrolysis system 100 and its individual components can vary as needed or desired. Also, the number and placement of various components of the electrolysis system 100 can vary as needed or desired.

Figure 2A:
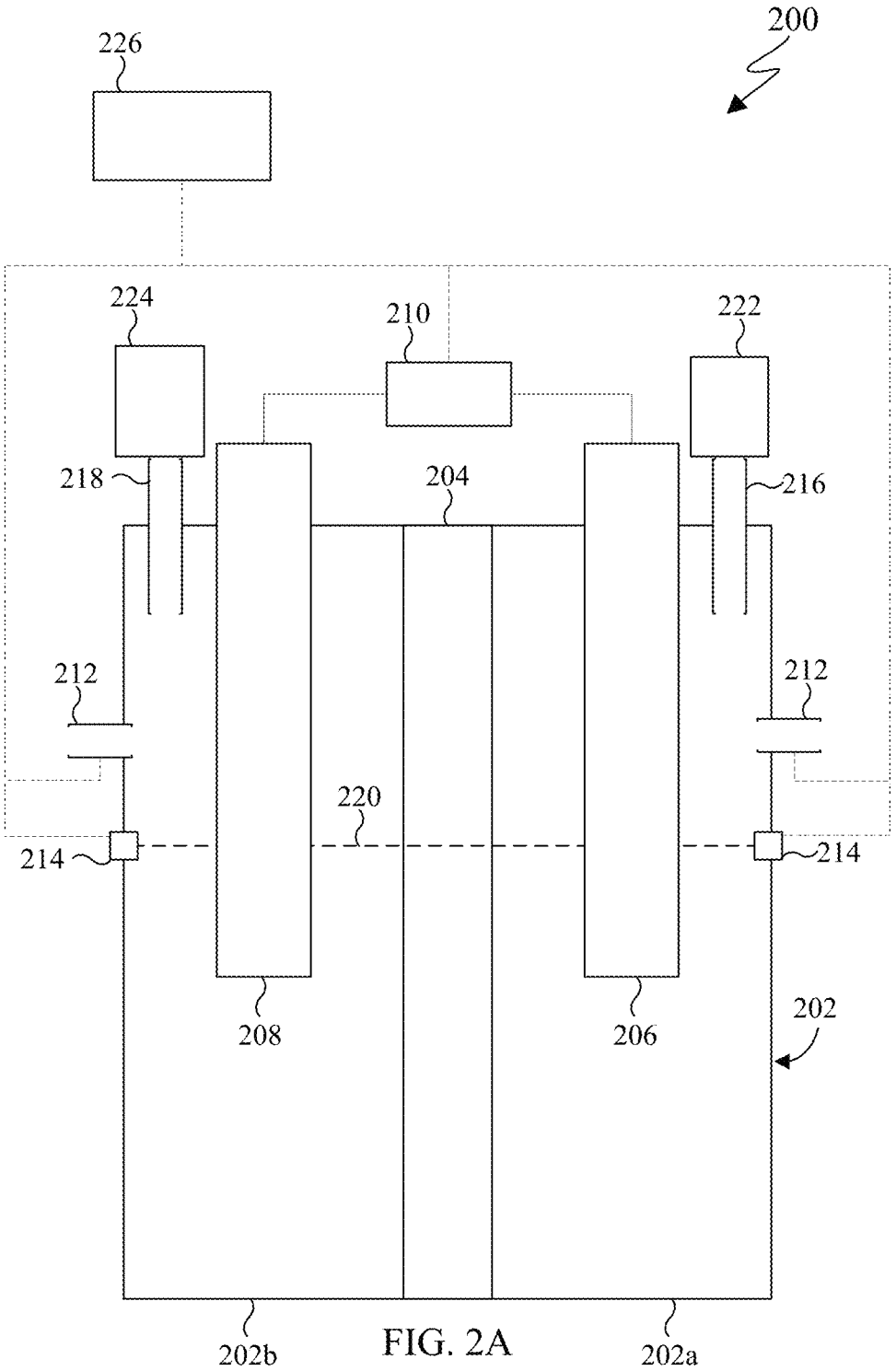
FIGS. 2A through 2D illustrate example electrolysis apparatuses in accordance with this disclosure.
Figure 2B:
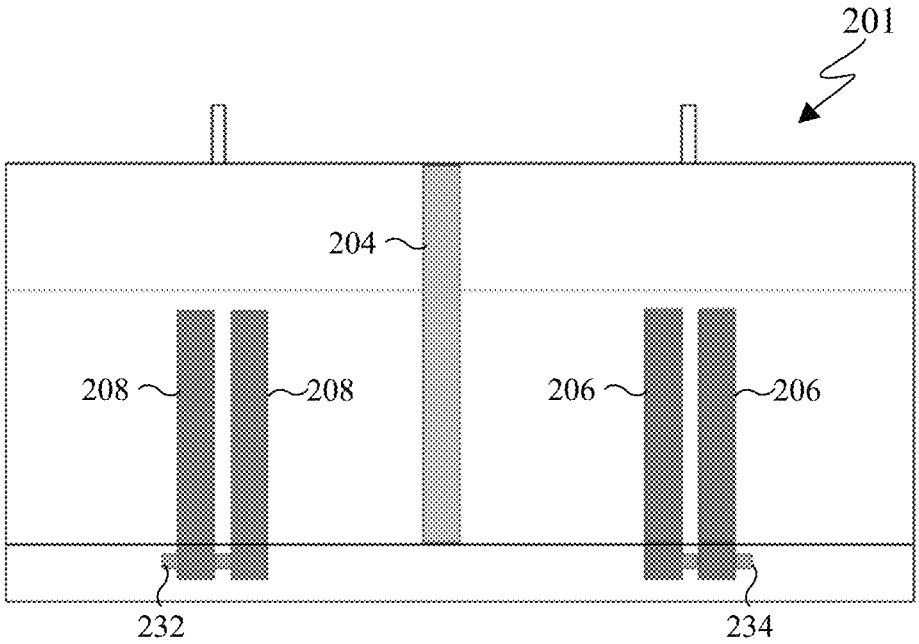
Figure 2C:
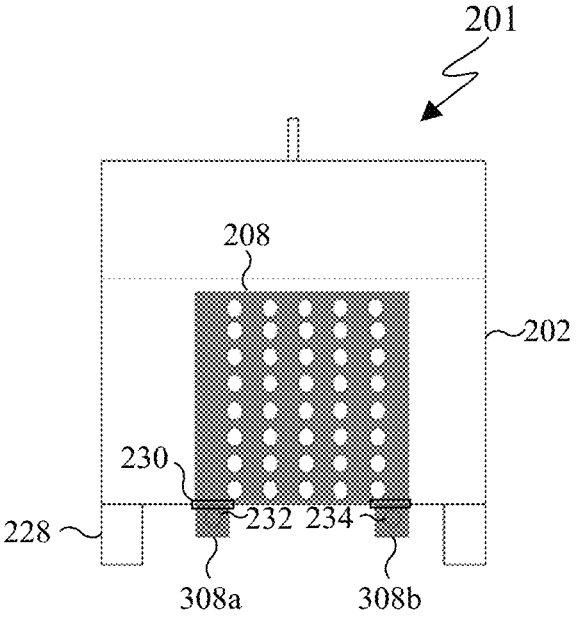
Figure 2D:
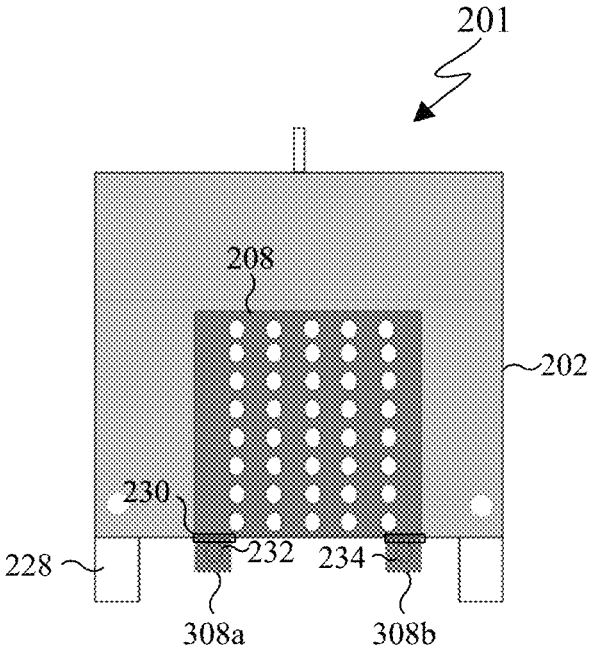

FIGS. 2A through 2D illustrate example electrolysis apparatuses 200, 201 in accordance with this disclosure. The embodiment of the electrolysis apparatus 200 illustrated in FIG. 2A and electrolysis apparatus 201 illustrated in FIGS. 2B through 2D are for illustration only. FIGS. 2A through 2C do not limit the scope of this disclosure to any particular implementation of an electrolysis apparatus. The electrolysis apparatus 201, shown in FIGS. 2B and 2C, includes multiple anodes 206 and cathodes 208.

As shown in FIG. 2A, an electrolysis apparatus 200 can perform electrolysis in a naturally occurring source material to separate a specific element. A direct current can be passed through an electrolyte producing chemical reaction for decomposition of the naturally occurring source material. In certain embodiments, the naturally occurring source material can be water and the electrolysis apparatus 200 can perform electrolysis on the water to separate hydrogen gas and oxygen gas. The hydrogen gas can be captured or contained for commercial use, energy generation, etc. The oxygen gas can also be separately captured or contained for commercial use or any other suitable use for oxygen gas. The electrolysis apparatus 200 can include a housing 202, a membrane 204, an anode plate 206, a cathode plate 208, and a power source 210. While the electrolysis apparatus 200 is illustrated with a single anode plate 206 and a single cathode plate 208, multiple anodes 206 and multiple cathodes 208 can be implemented in an electrolysis system 100. Furthermore, an amount of anodes 206 can be different from an amount of cathodes 208 included in an electrolysis system 100.

The housing 202 can be structured to hold the naturally occurring electrolyte. In certain embodiments, the housing 202 can be structured to hold water. The housing 202 can include one or more fluid inlets 212, one or more fluid level sensors 214, an anode outlet 216, and cathode outlet 218. The housing 202 can be in a shape of a hollow cylinder, a hollow rectangular prism, etc. An inside surface of the housing 202 can match the shape of the outside surface of the housing 202 or be different. For example, an outside surface of the housing 202 can be in a shape of a rectangular prism including an inner surface with a circular cross section.

The membrane 204 can be located in the housing 202 to separate the housing 202 into an anode chamber 202*a* and a cathode chamber 202*b*. The membrane 204 can be semi-permeable to allow transport of specific ions across the membrane 204, while blocking other ions and molecules. For example, the membrane 204 can allow passing of hydrogen ions while blocking passage of oxygen ions. The membrane 204 can be made from an organic or inorganic polymers or any other suitable material to allow ions to be transported through the membrane 204. The membrane can completely divide an interior of the housing or partially divide an interior of the housing. For example, the membrane 204 can extend from a bottom of the housing 202 to a height that would exceed a maximum level of electrolyte. A membrane 204 can be positioned between each instance of an anode chamber 202*a* and a cathode chamber 202*b*.

The one or more fluid inlets 212 can be located on the housing 202 to allow a fluid to be inserted into the housing 202. The fluid inlets 212 can further include a one-way valve to ensure that the fluid does not leak from the housing 202. The fluid inlets 212 can be arranged on the housing 202 in a manner to allow fluid to be inserted into the anode chamber 202*a* or the cathode chamber 202*b*. In certain embodiments, one or more fluid inlets 212 can be included on the housing 202 for each of the anode chamber 202*a* and the cathode chamber 202*b*. The valves of the fluid inlets 212 can be controlled by an electronic device 226 to regulate fluid input into the housing 202 and control a level of the fluid within the housing 202.

The one or more fluid level sensors 214 can be installed on the housing to measure a fluid level 220 of the fluid inside of the housing 202. The fluid level sensors 214 can be installed at different water levels or have the ability to measure a range of fluid levels 220. One or more fluid level sensors 214 can be installed in the anode chamber 202*a* of the housing 202. One or more fluid level sensors 214 can be installed in the cathode chamber 202*b* of the housing 202. The one or more fluid level sensors 214 can be connected to an electronic device 226. The fluid level 220 can be used by the electronic device 226 to determine when the valves of the fluid inlets allowing fluid to be inserted into the housing 202, the anode chamber 202*a*, and the cathode chamber 202*b*.

The anode plate 206 is an electrode through which the direct current is applied to the fluid stored in the housing 202. The anode plate 206 is inserted in the housing 202 at the anode chamber 202*a*. In certain embodiments, multiple anodes 206 can be inserted into the anode chamber 202*a*. A portion of the anode plate 206 extends below the fluid level 220. The anode plate 206 can be an electrically conductive wire, plate, or any other suitable electrically conductive structure. The anode plate 206 can be formed of an electronically conducting material that is chemically and physically stable, an electrocatalyst, and non-reactive with fluids in the housing 202. For example, the anode plate 206 can be formed of a metal/ceramic composite of an active metal and an electrolyte. Specific examples of materials that the anode plate 206 can be formed of include silver, lead, graphite, noble metals, and any other suitable material for electrolysis in a fluid.

In certain embodiments, the anode plate 206 can be connected to a bottom of the housing. This configuration allows an entire surface area of the anode plate 206 to be in contact with the electrolyte or fluid. A connection of the anode plate 206 can allow for an offset of the anode plate 206 from a surface of the housing 202 in which the anode plate 206 is connected to the housing 202.

The cathode plate 208 is an electrode through which the direct current leaves the fluid stored in the housing 202 after entering from the anode plate 206 and passing through the fluid and the membrane 204. The cathode plate 208 is inserted in the housing 202 at the cathode chamber 202*b*. In certain embodiments, multiple cathodes 208 can be inserted into the cathode chamber 202*b*. A portion of the cathode plate 208 extends below the fluid level 220. The cathode plate 208 can be an electrically conductive wire, plate, or any other suitable electrically conductive structure. In certain embodiments, multiple cathode plates can be inserted in the cathode chamber 202*b* with a narrow gap between each of the plates. The gap allows the fluid to surround the plates, which increases an amount of surface area that the fluid is exposed to. The anode plate 206 can be formed of an electronically conducting material that is chemically and physically stable, an electrocatalyst, and non-reactive with fluids in the housing 202. For example, the anode plate 206 can be formed of a metal/ceramic composite of an active metal and an electrolyte. Specific example that the anode plate 206 can be formed of include silver, lead, graphite, noble metals, and any other suitable material for electrolysis in a fluid.

This configuration allows an entire surface area of the cathode plate 208 to be in contact with the electrolyte or fluid. A connection of the cathode plate 208 can allow for an offset of the cathode plate 208 from a surface of the housing 202 in which the cathode plate 208 is connected to the housing 202.

The power source 210 provides the direct current to the anode plate 206 and receives the returned direct current from the cathode plate 208. The external power source 210 can be manually operated or controlled by the electronic device 226. As the direct current passes through the fluid from the anode plate 206 to the cathode plate 208, the fluid reacts to direct current. In certain embodiments, the direct current is passed through water in the housing 202. The water reacts at the anode plate 206 to form oxygen and positively charged hydrogen ions. The fluid at the anode plate 206 goes through a reaction as follows.

$$2H_2O \rightarrow O_2 + 4H^+ + 4e^- \quad (1)$$

The water ($H_2O$) is split into oxygen gas ($O_2$) and positively charged hydrogen ($H^+$). The positively charged hydrogen ions pass through the membrane 204 with the electrons ($e^-$)

to the cathode plate 208. At the cathode plate 208, the positively charged hydrogen ions combine with the electrons to form hydrogen gas through a reaction as follows.

$$4H^{+}+4e^{-}\rightarrow 2H_2 \quad (2)$$

The anode outlet 216 can be located on the housing 202 in relation to the anode chamber 202*a*. The housing 202 can include multiple anode outlets 216. The anode outlets 216 allow the oxygen gas to exit the anode chamber 202*a* of the housing. The oxygen can be released into the surrounding atmosphere, can be contained in an anode gas storage 222, can be directed to another apparatus or component of a system in which the electrolysis apparatus 200 is installed. The anode gas storage 222 can be a gas storage that is removably coupled to one or more of the anode outlets 216.

The cathode outlet 218 can be located on the housing 202 in relation to the cathode chamber 202*b*. The housing 202 can include multiple cathode outlets 218. The cathode outlets 218 allow the hydrogen gas to exit the cathode chamber 202*b* of the housing. The hydrogen can be contained in a cathode gas storage 224, directed to another apparatus or component of a system in which the electrolysis apparatus 200 is installed, or directed in any suitable manner. The cathode gas storage 224 can be a gas storage that is removably coupled to one or more of the cathode outlets 218.

The electrolysis apparatuses 200, 201 can also include a plurality of stands 228. The stands 228 can elevate a base of the electrolysis apparatus 200, 201. The stands 228 allow for space underneath the electrolysis apparatuses 200, 201 for running electrical cables for connecting the anode plate 206 and cathode plate 208. The anode plate 206 and cathode plate 208 can be attached at a bottom surface of the housing 202 and an anode tab 308*a* of the anode plate 206 and a cathode tab of the cathode plate 208 can extend to an exterior of the housing 202. The anode tab 308*a* of the anode plate 206 and cathode tab 308*b* of the cathode plate 208 are used for both installing the anode plate 206 and cathode plate 208 to the housing and for electrical connections. The anode tab 308*a* of the anode plate 206 can align on one side of the housing 202 and the cathode tab 308*b* of the cathode can align on an opposite side of the housing 202 from the anode tab 308*a*. The electrolysis apparatus 200, 201 can include seals 230 for the tabs 308*a*, 308*b* for sealing any space between the tabs 308*a*, 308*b* and the housing 202.

The electrolysis apparatus 200, 201 can also include an anode link 232 and a cathode link 234. The anode link 232 can electrically connect two or more of the anode tabs 308*a*. The cathode link 234 can electrically connect two or more of the cathode tabs 308*b*. In this manner, the external power source 210 can be connected directly to each anode link 232 and cathode link 234 for routing electricity through the anode link 232 to the anodes 206 and through the cathode link 234 to the cathodes 208 inside of the housing 202.

Although FIGS. 2A-2D illustrate example electrolysis apparatuses 200, 201, various changes may be made to FIGS. 2A-2D. For example, the sizes, shapes, and dimensions of the electrolysis apparatuses 200, 201 and their individual components can vary as needed or desired. Also, the number and placement of various components of the electrolysis apparatuses 200, 201 can vary as needed or desired.

Figure 3B:
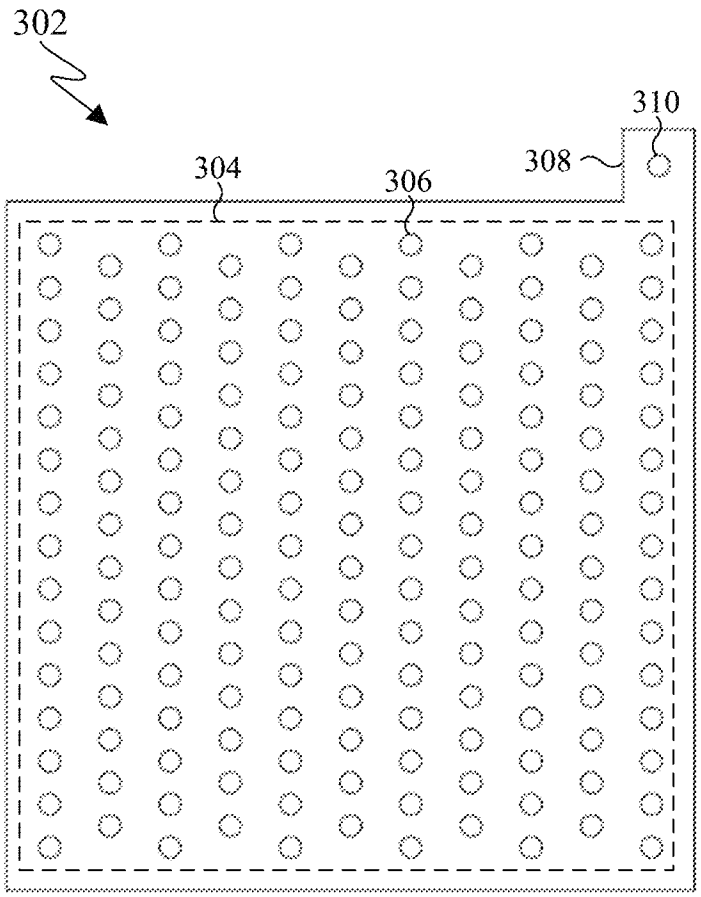
FIGS. 3A and 3B illustrates an example plates for cathodes and anodes in accordance with this disclosure.
Figure 3A:
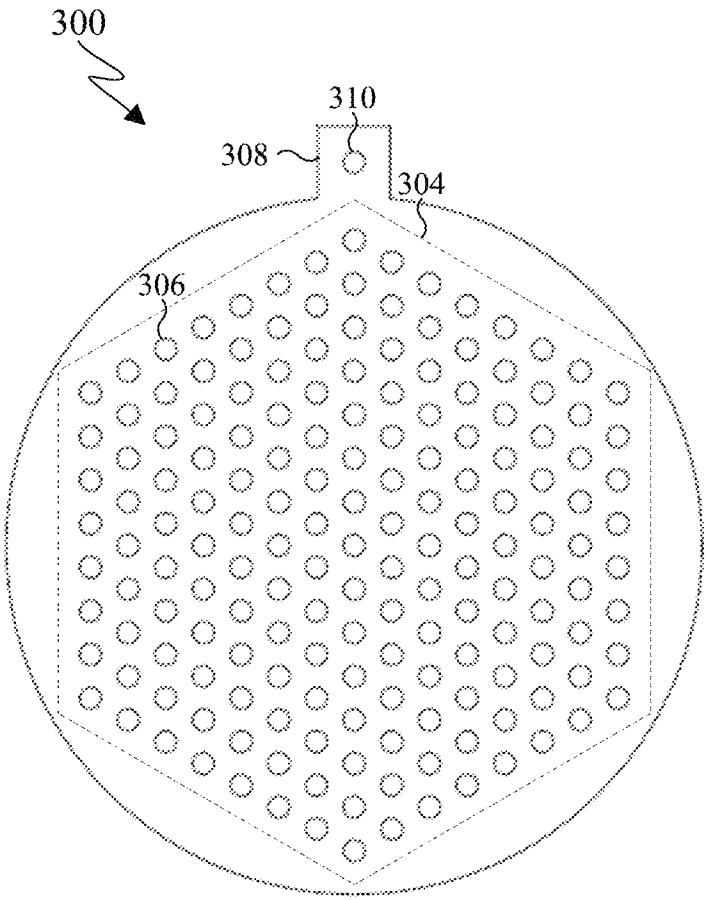

FIGS. 3A and 3B illustrates an example plates 300, 302 for cathodes and anodes in accordance with this disclosure. In particular, FIG. 3A illustrates a round plate 300 and FIG. 3B illustrates a rectangular plate 302. The embodiments of the plates 300, 302 illustrated in FIGS. 3A and 3B are for illustration only. FIGS. 3A and 3B do not limit the scope of this disclosure to any particular implementation of an electrode plates.

As shown in FIGS. 3A and 3B, plates 300, 302 can be implemented in the electrolysis apparatus 200 shown in FIG. 2. The plates 300, 302 can be anodes 206 or cathodes 208 respectively inserted in the anode chamber 202*a* and the cathode chamber 202*b*. the plates 300, 302 can range in thickness depending on a suitable amount of hydrogen required to be generated. For example, the plates 300, 302 can be designed to have a thickness of 2 mm or greater. The plates 300, 302 can be design based on an inside of the housing 202. For optimal surface area exposure of the plates 300, 302, the shape of the plate can be designed based on an inside of the housing 202. For example, when the housing 202 is a tube shape, the round plate 300 would be suitable. When the housing is in a rectangular shape, the rectangular plate 302 would be suitable. While matching the shape of the plates 300, 302 with the shape of the housing 202 would increase efficiency, the plates 300, 302 could be mismatched with a shape of the housing 202. A size of the plates 300, 302 could be designed based on a size of the housing. For example, the size of the plate can be based on a size of the interior of the electrolysis apparatus 200 and a fluid gap where the fluid gap can be based on a flow of the fluid. For example, a size of the plate with a 20 mm thickness could be 20 cm wide. In certain embodiments, the plates 300, 302 for the anode plate 206 can be different from the plates 300, 302 for the cathode plate 208, including shape, size, etc.

The plates 300, 302 can also include a hole pattern 304 of a plurality of holes 306. While using the term "pattern", the hole pattern 304 could include a random arrangement of holes 306 that would not conform to a repeatable pattern. The hole pattern 304 can extend across an entire surface or multiple surfaces of plates 300, 302. The holes 306 can be vertically implemented in the plates 300, 302, horizontally implemented in the plates 300, 302, or implemented at any suitable orientation. The orientation of the holes 306 can be determined based on the arrangement of the plates 300, 302 inside of the housing 202. The holes 306 can have any shape, size, orientation, or depth based on the inside of the electrolysis apparatus 200. The holes 306 for the anode plate 206 can be different from the holes 306 for the cathode plate 208. In certain embodiments, the holes 306 can be implemented exclusively in either of the anode plate 206 or cathode plate 208 or implemented in both of the anode plate 206 and cathode plate 208. The holes 306 can be any depth through the plates 300, 302.

The plates 300, 302 also include a plate tab 308 with a tab hole 310. The plate tab 308 can be used to electrically connect the plates 300, 302. The tab hole 310 can fit around a protrusion or have a rod or bolt extended through the plate tab 308 from the housing 202 to lock a position of the plates 300, 302 as well as provide an electrical connection for generating the current through the electrolyte.

The plate tab 308 can also be used to connect each respective plate 300, 302 with the housing 202. The plate tab 308 can be any suitable shape to connect with the housing 202. The plate tab 308 can extend into a matching recession of the housing 202 that could dually include an electrical connection that would not be exposed directly to the inside of the housing 202.

In certain embodiment, multiple plates 300, 302 can be implemented in the housing 202. The multiple plates 300, 302 can have varying dimensions. For example, plates 300, 302 used as cathodes 208 can have a thickness reduced or increased based on a distance from the anode plate 206. The multiple plates 300, 302 can also vary in dimension with a shape of the housing 202. For example, the housing 202 could be shaped as a cylinder with a greater diameter a center of the cylinder than the ends of the cylinder. The multiple plates 300, 302 could be reduced in diameter accordingly with the reduction in diameter from a center of the housing 202.

Multiple plates 300, 302 can also have different hole patterns 304. For example, the hole patterns 304 of adjacent plates 300, 302 can be aligned or misaligned. The hole patterns 304 can be different in adjacent plates 300, 302. The dimensions of the holes 306 can vary between adjacent plates.

Although FIGS. 3A and 3B illustrate plates 300, 302, various changes may be made to FIGS. 3A and 3B. For example, the sizes, shapes, and dimensions of the plates 300, 302 can vary as needed or desired. Also, the number and placement of plates 300, 302 in the electrolysis apparatus 200 can vary as needed or desired. In addition, the plates 300, 302 may be used in any other suitable electrolysis process and is not limited to the specific processes described herein.

Figure 4:
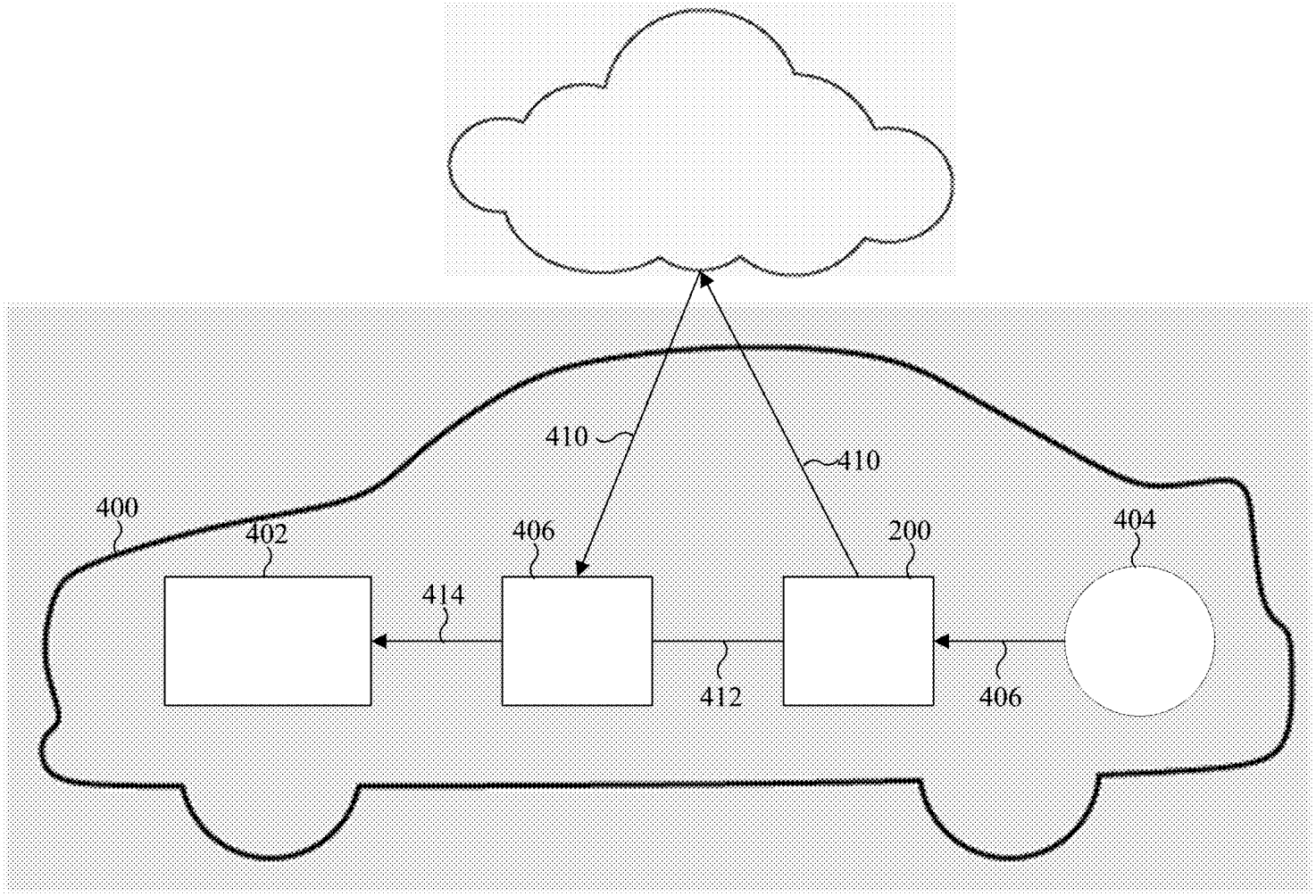
FIG. 4 illustrates an example hydrogen vehicle using an electrolysis apparatus in accordance with this disclosure.

FIG. 4 illustrates an example hydrogen vehicle 400 using an electrolysis apparatus 200 in accordance with this disclosure. The embodiment of the hydrogen vehicle 400 illustrated in FIG. 4 is for illustration only. FIG. 4 does not limit the scope of this disclosure to any particular implementation of a hydrogen vehicle.

As shown in FIG. 4, a hydrogen vehicle 400 runs using an engine 402 to operate. The hydrogen vehicle 400 can be any mode of transport that utilizes an engine to operate. For example, the hydrogen vehicle 400 can be a car, truck, semitruck, bicycle, airplane, boat, or any other vehicle that can utilize an engine 402. The hydrogen vehicle 400 also includes an electrolysis apparatus 200, a water tank 404, and a fuel cell 406.

Water 408 is stored in the water tank 404, which can be removable or fillable from an outside of the hydrogen vehicle 400. The water tank 404 can be connected to one or more fluid inlet 212 of the electrolysis apparatus 200. The water tank 404 can be fluidly connected to a fluid inlet of the anode chamber 202*a* or a fluid inlet of the cathode chamber 202*b*. The water 408 from the water tank 404 can be used to replenish or maintain a fluid level 220 of the anode chamber 202*a* and the cathode chamber 202*b*. While describe as a water tank 404, any suitable fluid that produces hydrogen through electrolysis can be stored in the water tank 404 for use by the engine 402.

The water 408 is inserted into the electrolysis apparatus 200 through the fluid inlets 212 to maintain a fluid level 220 of the anode chamber 202*a* and the cathode chamber 202*b*. The water 408 is converted by the apparatus into oxygen gas 410 and hydrogen gas 412. The oxygen gas 410 is output through the anode outlet 216 and the hydrogen gas is output through the cathode outlet 218. The oxygen gas 410 can be released into the atmosphere. The hydrogen gas 412 is output to the fuel cell 406.

The fuel cell 406 can use a reverse electrolysis procedure to transform the hydrogen gas 412 into energy to power the engine 402. The fuel cell captures energy output when the hydrogen gas 412 is exposed to oxygen gas 410. The engine 402 can use the energy generated from the fuel cell 406 to output force to put the hydrogen vehicle 400 into motion.

Although FIG. 4 illustrate a hydrogen vehicle 400, various changes may be made to FIG. 4. For example, the sizes, shapes, and dimensions of the hydrogen vehicle 400 and its individual components can vary as needed or desired. Also, the number and placement of various components of the hydrogen vehicle 400 can vary as needed or desired.

Figure 5:
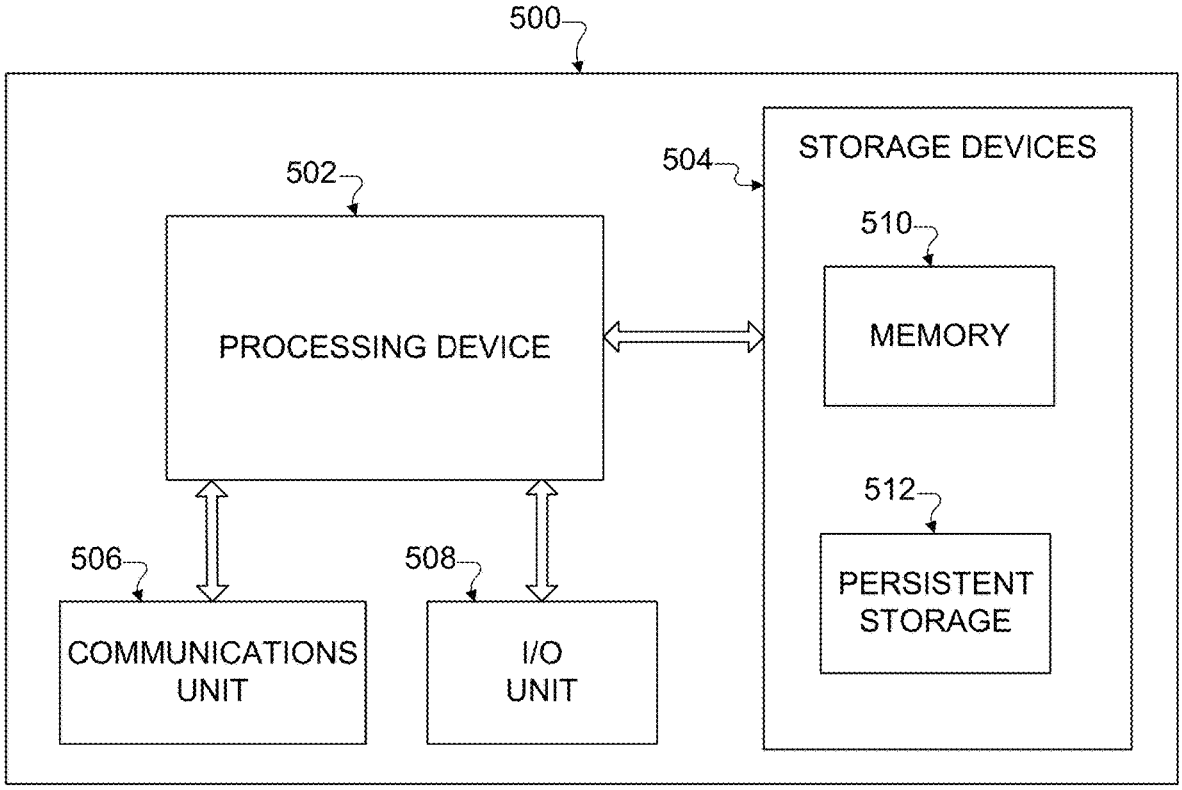
FIG. 5 illustrates an example device for control of an electrolysis apparatus in accordance with this disclosure.

FIG. 5 illustrates an example device 500 for control of an electrolysis apparatus 200 according to this disclosure. One or more instances of the electronic device 500 (or portions thereof) may, for example, be used to at least partially implement the functionality of the electronic device 226 of FIG. 2. However, the functionality of the electronic device 500 may be implemented in any other suitable manner.

As shown in FIG. 5, the electronic device 500 denotes a computing device or system that includes at least one processing device 502, at least one storage device 504, at least one communications unit 506, and at least one input/output (I/O) unit 508. The processing device 502 may execute instructions that can be loaded into a memory 510. The processing device 502 includes any suitable number(s) and type(s) of processors or other devices in any suitable arrangement. Example types of processing devices 502 include one or more microprocessors, microcontrollers, DSPs, ASICs, GPUs, FPGAs, or discrete circuitry.

The memory 510 and a persistent storage 512 are examples of storage devices 504, which represent any structure(s) capable of storing and facilitating retrieval of information (such as data, program code, and/or other suitable information on a temporary or permanent basis). The memory 510 may represent a random-access memory or any other suitable volatile or non-volatile storage device(s). The persistent storage 512 may contain one or more components or devices supporting longer-term storage of data, such as a read only memory, hard drive, Flash memory, or optical disc.

The communications unit 506 supports communications with other systems or devices. For example, the communications unit 506 can include a network interface card or a wireless transceiver facilitating communications over a wired or wireless network. The communications unit 506 may support communications through any suitable physical or wireless communication link(s).

The I/O unit 508 allows for input and output of data. For example, the I/O unit 508 may provide a connection for user input through a keyboard, mouse, keypad, touchscreen, or other suitable input device. The I/O unit 508 may also send output to a display or other suitable output device. Note, however, that the I/O unit 508 may be omitted if the electronic device 500 does not require local I/O, such as when the electronic device 500 can be accessed remotely or operated autonomously.

In some embodiments, the instructions executed by the processing device 502 can include instructions that implement all or portions of the functionality of the electrolysis apparatus 200 described above. For example, the instructions executed by the processing device 502 can include instructions for controlling electrolysis in the electrolysis apparatus 200 as described above.

Although FIG. 5 illustrates one example of an electronic device 500 for controlling electrolysis in an electrolysis apparatus 200, various changes may be made to FIG. 5. For example, computing devices and systems come in a wide variety of configurations, and FIG. 5 does not limit this disclosure to any particular computing device or system.

In some embodiments, various functions described in this patent document are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Although the present disclosure has been described with exemplary embodiments, various changes and modifications may be suggested to one skilled in the art. It is intended that the present disclosure encompass such changes and modifications as fall within the scope of the appended claims. None of the description in this application should be read as implying that any particular element, step, or function is an essential element that must be included in the claims scope. The scope of patented subject matter is defined by the claims.

What is claimed is:

1. An apparatus to generate hydrogen comprising:
- a housing configured to contain a fluid;
- an anode plate installed in the housing and configured to extend into the fluid, the anode plate including a plurality of holes;
- a plurality of cathode plates installed in the housing and configured to extend into the fluid, each cathode plate including a plurality of holes, the plurality of cathode plates horizontally spaced apart from the anode plate, wherein the plurality of cathode plates have different thicknesses based on respective distances from the anode plate;
- a membrane located in the housing and configured to separate the anode plate and the plurality of cathode plates; and
- a power source mounted on the housing and electrically coupled to the anode plate and the plurality of cathode plates.

2. The apparatus of claim 1, wherein the holes extend through each cathode plate.

3. The apparatus of claim 1, wherein the holes partially extend through each cathode plate.

4. The apparatus of claim 1, wherein the holes extend in a vertical direction when the plurality of cathode plates are mounted in the housing.

5. The apparatus of claim 1, wherein the holes extend at a diagonal direction when the plurality of cathode plates are mounted in the housing.

6. The apparatus of claim 1, wherein:
- the housing is in a shape of a cylinder, and
- a shape of each cathode plate is round to align with an inside cylindrical surface of the housing.

7. The apparatus of claim 1, wherein:
- the housing is in a shape of a rectangular prism, and
- a shape of each cathode plate is rectangular to align with an inside rectangular surface of the housing.

8. The apparatus of claim 1, wherein holes of adjacent cathode plates are aligned.

9. The apparatus of claim 1, wherein patterns of adjacent cathode plates are different.

10. A hydrogen vehicle comprising:
- an electrolysis apparatus to generate hydrogen comprising:
  - a housing configured to contain a fluid;
  - an anode plate installed in the housing and configured to extend into the fluid, the anode plate including a plurality of holes;
  - a plurality of cathode plates installed in the housing and configured to extend into the fluid, each cathode plate including a plurality of holes, the plurality of cathode plates horizontally spaced apart from the anode plate, wherein the plurality of cathode plates have different thicknesses based on respective distances from the anode plate;
  - a membrane located in the housing and configured to separate the anode plate and the plurality of cathode plates;
  - a power source mounted on the housing and electrically coupled to the anode plate and the plurality of cathode plates; and
- a hydrogen engine fluidly connected to the electrolysis apparatus to receive the generated hydrogen and configured to operate on the generated hydrogen.

11. The hydrogen vehicle of claim 10, wherein the holes extend through each cathode plate.

12. The hydrogen vehicle of claim 10, wherein the holes partially extend through each cathode plate.

13. The hydrogen vehicle of claim 10, wherein the holes extend in a vertical direction when the plurality of cathode plates are mounted in the housing.

14. The hydrogen vehicle of claim 10, wherein the holes extend at a diagonal direction when the plurality of cathode plates are mounted in the housing.

15. The hydrogen vehicle of claim 10, wherein:
- the housing is in a shape of a cylinder, and
- a shape of each cathode plate is round to align with an inside cylindrical surface of the housing.

16. The hydrogen vehicle of claim 10, wherein:
- the housing is in a shape of a rectangular prism, and
- a shape of each cathode plate is rectangular to align with an inside rectangular surface of the housing.

17. The hydrogen vehicle of claim 10, wherein holes of adjacent cathode plates are aligned.

18. The hydrogen vehicle of claim 10, wherein patterns of adjacent cathode plates are different.

19. The apparatus of claim 1, wherein the thicknesses of the plurality of cathode plates are reduced based on the respective distances from the anode plate.

20. The apparatus of claim 1, wherein the thicknesses of the plurality of cathode plates are increased based on the respective distances from the anode plate.

* * * * *